US010985496B2

(12) United States Patent
Pamart

(10) Patent No.: US 10,985,496 B2
(45) Date of Patent: Apr. 20, 2021

(54) CABLE CLAMPING DEVICE FOR SEALED ELECTRICAL CONNECTOR AND ELECTRICAL CONNECTOR

(71) Applicant: Tyco Electronics France SAS, Pontoise (FR)

(72) Inventor: Olivier Pamart, Ecouen (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 16/415,268

(22) Filed: May 17, 2019

(65) Prior Publication Data

US 2019/0356087 A1 Nov. 21, 2019

(30) Foreign Application Priority Data

May 18, 2018 (FR) ..... 1854181

(51) Int. Cl.

| | |
|---|---|
| ***H01R 13/58*** | (2006.01) |
| ***H01R 13/436*** | (2006.01) |
| ***H01R 13/506*** | (2006.01) |
| ***H01R 13/52*** | (2006.01) |

(52) U.S. Cl.

CPC ..... *H01R 13/5812* (2013.01); *H01R 13/4362* (2013.01); *H01R 13/506* (2013.01); *H01R 13/5205* (2013.01)

(58) Field of Classification Search

CPC ..... H01R 13/5812; H01R 13/4362; H01R 13/5205; H01R 13/506; H01R 13/5221; H01R 13/58126; H02G 15/04; H02G 15/007

See application file for complete search history.

(56) References Cited

U.S. PATENT DOCUMENTS

| | | | | |
|---|---|---|---|---|
| 4,299,363 | A * | 11/1981 | Datschefski | H02G 3/083 16/108 |
| 4,842,364 | A * | 6/1989 | Chen | G02B 6/3807 174/70 R |
| 5,290,073 | A * | 3/1994 | Chen | F16L 5/08 277/621 |
| 5,442,141 | A * | 8/1995 | Gretz | H02G 3/081 174/152 G |
| 5,669,590 | A * | 9/1997 | Przewodek | F16L 3/237 248/68.1 |
| 7,534,965 | B1 * | 5/2009 | Thompson | H02G 3/22 16/2.1 |
| 9,343,890 | B2 * | 5/2016 | Pelletier | H02G 3/0658 |
| 9,728,891 | B2 * | 8/2017 | Casses | H01R 13/582 |
| 10,084,301 | B2 * | 9/2018 | Persson | H02G 15/013 |
| 10,125,900 | B2 * | 11/2018 | Penrod | B60R 99/00 |
| 10,290,970 | B1 * | 5/2019 | Weber, Jr. | H01R 13/5812 |

(Continued)

FOREIGN PATENT DOCUMENTS

| | | | |
|---|---|---|---|
| EP | 1701410 | A2 | 9/2006 |
| WO | 2016135303 | A1 | 9/2016 |

OTHER PUBLICATIONS

Search Report, App. No. FR1854181, dated Jan. 15, 2019, 10 pages.

*Primary Examiner* — Briggitte R. Hammond
(74) *Attorney, Agent, or Firm* — Barley Snyder

(57) ABSTRACT

A cable clamping device for a housing of a sealed electrical connector comprises a grid having an orifice adapted to receive a cable and clamp the cable in the orifice.

19 Claims, 3 Drawing Sheets

(56) References Cited

U.S. PATENT DOCUMENTS

| | | | | |
|---|---|---|---|---|
| 2011/0315442 | A1* | 12/2011 | Nolting | H01R 13/506<br>174/652 |
| 2012/0276762 | A1* | 11/2012 | Hohner | H01R 9/0527<br>439/98 |
| 2017/0149170 | A1* | 5/2017 | Tait | H01R 13/506 |

* cited by examiner

CABLE CLAMPING DEVICE FOR SEALED ELECTRICAL CONNECTOR AND ELECTRICAL CONNECTOR

CROSS-REFERENCE TO RELATED APPLICATION

This application claims the benefit of the filing date under 35 U.S.C. § 119(a)-(d) of French Patent Application No. 1854181, filed on May 18, 2018.

FIELD OF THE INVENTION

The present invention relates to a cable clamping device and, more particularly, to a cable clamping device for a sealed electrical connector.

BACKGROUND

For sealed electrical connectors, a rear grid associated with a sealing joint is commonly used at an opening of a housing of the sealed electrical connector, at which the electrical cables are inserted. The rear grid has orifices dimensioned to receive the electrical cables and retains and compresses the sealing joint.

In sealed connectors, the insulation of the electrical cables, unlike the crimping terminals situated further inside the housing, is not crimped. This makes the sealed housings vulnerable to tensile stress when the cables are pulled in a direction opposite the direction of insertion of the cable into the housing, for example, during handling and/or use of the connector.

SUMMARY

A cable clamping device for a housing of a sealed electrical connector comprises a grid having an orifice adapted to receive a cable and clamp the cable in the orifice.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
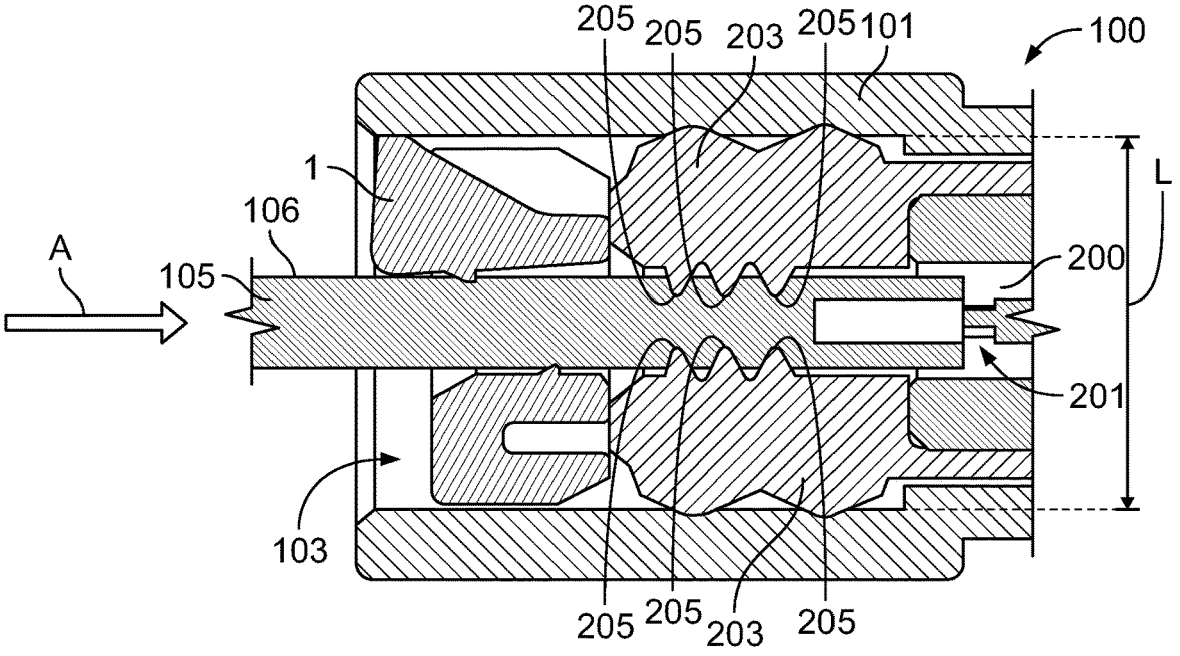
FIG. 1 is a sectional side view of an electrical connector according to an embodiment.

Embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the disclosure will convey the concept of the invention to those skilled in the art.

The person skilled in the art will appreciate that the present invention can be applied substantially to any type of electrical connector, in particular to any type of sealed electrical connector.

Figure 2A:
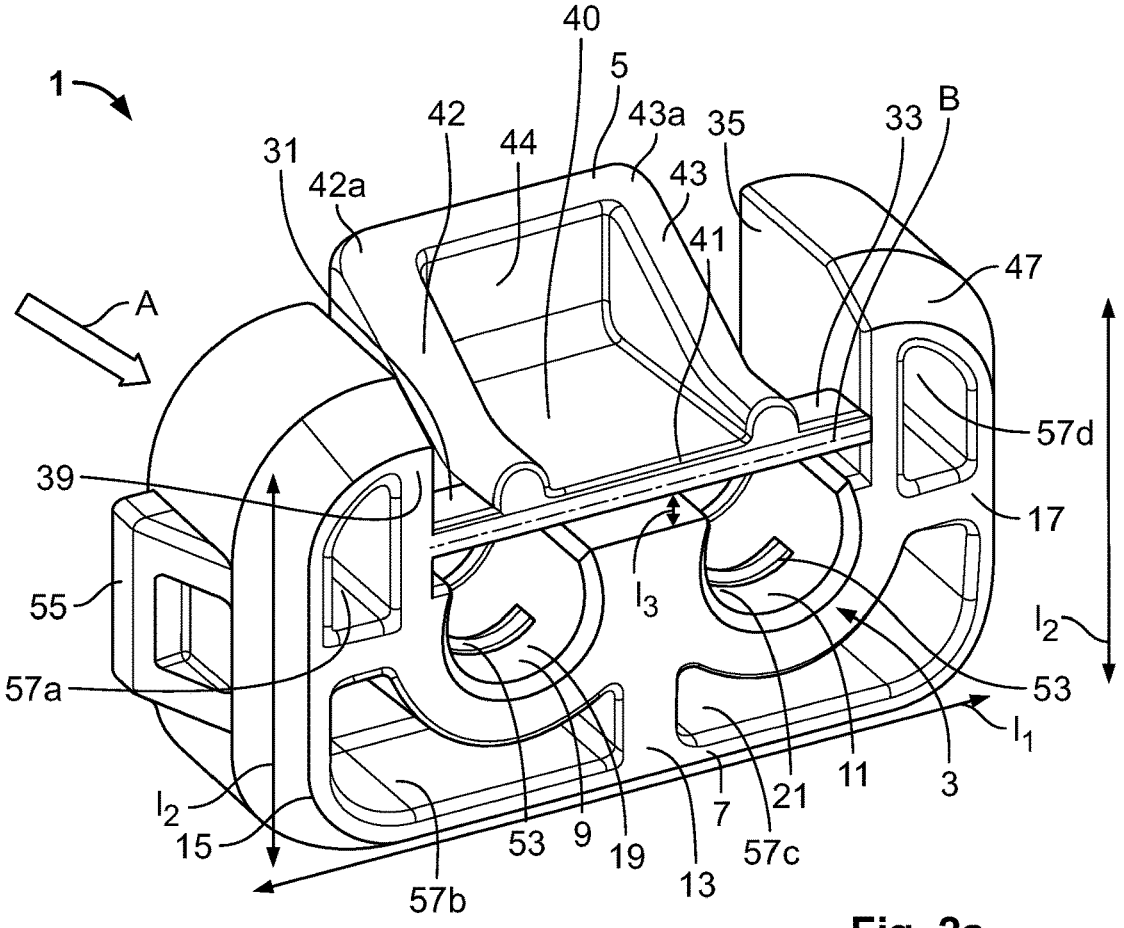
FIG. 2A is a perspective view of a clamping device according to an embodiment.
Figure 2B:
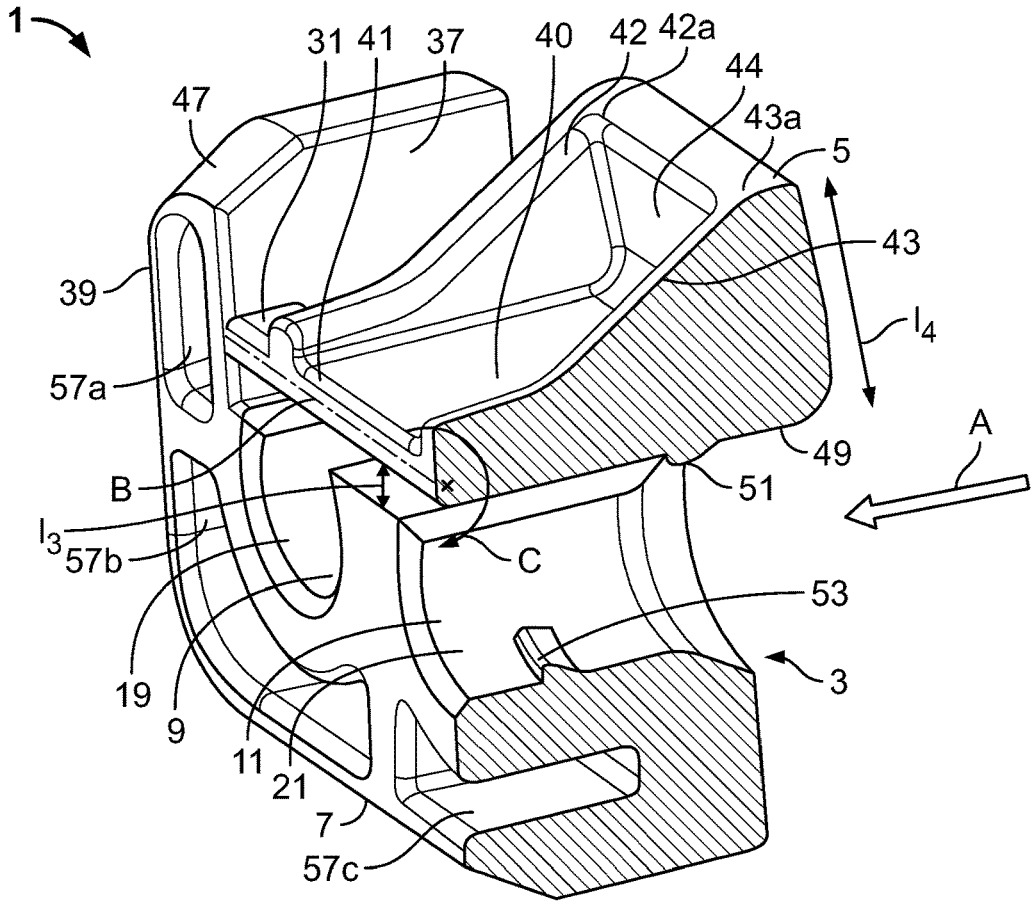
FIG. 2B is a sectional perspective view of the clamping device.

An electrical connector 100 according to an embodiment is shown in FIG. 1. The connector 100 comprises a housing 101 which is provided with an opening 103 of height L. An electrical cable 105 provided with an insulation 106 is introduced through the opening 103. A clamping device 1, described in greater detail below with reference to FIGS. 2A and 2B, is positioned in the opening 103. The clamping device 1 has been introduced along the insertion direction A. The electrical cable 105 and the insulation 106 pass through the clamping device 1 and are inserted as far as an interior 200 of the housing 101. At the interior 200 of the housing 101, the cable 105 is stripped of its insulation 106 and is crimped in a crimping region 201.

In the shown embodiment, the electrical connector 100 is a sealed electrical connector, and the insulation 106 of the electrical cable 105 is not crimped for sealing reasons. In order to ensure the sealing, the electrical connector 100 has a sealing plug 203 with a plurality of lips 205 sealing of the connector 100.

The clamping device 1, as shown in FIGS. 2A and 2B, has a grid 3 with a first jaw 5 and a second jaw 7 forming between them two substantially circular orifices 9, 11 which are configured for receiving electrical cables. The dimensions of the receiving orifices 9, 11 are suitable for the dimensions of the electrical cables. In the shown embodiment, the grid 3 has two orifices 9, 11, but in other embodiments, the grid 3 can have more orifices. In another embodiment, only one orifice can be present.

The cable clamping device 1, in the shown embodiment, is produced from a single monolithic piece in an elastically deformable plastic material. This makes it possible to reduce the number of components in the sealed electrical connector 100 and to offer an easy assembly.

In the embodiment shown in FIGS. 2A and 2B, the second jaw 7 has a U-shape, a length 11 of a central part 13 is longer than a length 12 of a pair of side parts 15, 17. One skilled in the art will appreciate that the dimensions of the second jaw 7 are adapted to the dimensions of the opening 103 of the housing 101 of the electrical connector 100. The central part 13 of the second jaw 7 is recessed to have a pair of circular kerfs 19, 21 which, in combination with the first jaw 5, form the orifices 9, 11 for receiving the electrical cables.

The first jaw 5 is positioned in the U-shaped opening of the second jaw 7, as shown in FIGS. 2A and 2B. Two hinges 31, 33 are used to connect the two jaws 5, 7. An internal wall 49 of a planar surface 40 of the first jaw 5, which faces the central part 13 of the second jaw 7, is used to close the orifices 9, 11. A distance 13 between the two circular kerfs 19, 21 and the wall 49 of the first jaw 5 is adapted to the diameters of the one or more electrical cables in order to permit easy insertion of the cables into the orifices 9, 11.

As shown in FIGS. 2A and 2B, starting from a lower side 41, adjacent to the hinges 31, 33 of the planar surface 40 of the first jaw 5, two ramps 42, 43 extend perpendicularly and are linked together at their vertices 42*a*, 43*a* via a rear wall 44 extending likewise perpendicularly from the planar surface 40. The rear wall 44 is on the side opposite the lower side 41 which will be used to enter into a housing of a connector; an introduction direction is shown with the arrow A. The ramp 42, 43 increases in the direction opposite the introduction direction A. This particular ramp 42, 43 geometry makes it possible to facilitate the insertion of the first jaw 5 into an opening of an electrical housing, since the clamping device 1 is inserted on the lower side 41 towards the vertex 42*a*, 43*a* of the first jaw 5. In the shown embodiment, the space between the two ramps 42, 43 is empty but, in another embodiment, this space could be filled with the same material used for the grid 3.

The two hinges 31, 33 are elastically deformable in such a way as to permit a rotary pivoting of the first jaw 5 with respect to the second jaw 7. A rotation axis B is perpendicular to the insertion direction A. The two hinges 31, 33, which are integral with and perpendicular to the two internal side walls 35, 37 of the second jaw 7, are also perpendicular to the direction of insertion A of the clamping device 1 into an opening of a housing.

The two hinges 31, 33 define between them the rotation axis B around which the first jaw 5 can pivot. The first jaw 5 is thus pivoted in rotation around the axis B which links the two hinges 31, 33 as indicated by the arrow C in FIG. 2C. The first jaw 5 and the second jaw 7 are thus mobile in relation to one another and can clamp electrical cables in the orifices 9, 11 by closing when pressure is applied on the vertex 42*a*, 43*a* of the first jaw 5, for example as an electrical conductor is introduced into an opening of a housing.

As shown in FIG. 2B, a height 14 of the rear wall 44, which also corresponds to the height of the vertices 42*a*, 43*a* of the ramps 42, 43 of the first jaw 5, is dimensioned such that it makes the grid 3 significantly wider than the opening 103 of height L of the housing 101 into which the cable clamping device 1 is to be inserted, as shown in FIG. 1. In particular, the height 14 is dimensioned such that the insertion of the first jaw 5 into the opening 103 of the housing 101 causes a pivoting around the axis B of the first jaw 5 in order to clamp the jaws 5, 7 onto the cables in the orifices 9, 11, as will be further described with reference to FIGS. 3A-3C.

The wall 49 of the first jaw 5 facing the orifices 9, 11 as well as the circular kerfs 19, 21 of the second jaw 7 are provided with retaining shapes 51, 53, as shown in FIGS. 2A and 2B, for the jamming of the cables. The first jaw 5 and the second jaw 7 are provided with protrusions 51, 53 in the shape of ramps, the slopes of which have directions opposed to one another, which serves to further improve the clamping of an electrical cable.

The wall 39 of the second jaw 7, adjacent to the lower side 41 of the first jaw 5, has a protrusion 55, shown in FIG. 2A, permitting a snap-locking of the grid 3 in a housing. This protrusion 55 has a ramp structure, the slope of which descends in the insertion direction A, which makes it possible to facilitate the insertion of the clamping device 1 into an opening of a housing. This protrusion 55 makes it possible to ensure the holding of the grid 3 and thus of the clamping device 1 in an opening of an electrical housing. This snap-locking is especially necessary during use of the sealed electrical connector in environments which are subject to vibrations and/or to impacts.

In the embodiment shown in FIGS. 2A and 2B, the wall 39 of the second jaw 7 has a plurality of recesses 57*a*, 57*b*, 57*c*, 57*d* so as to further lighten the cable clamping device 1 and to facilitate the deformation in order to be able to introduce the grid 3 into the housing 101. A periphery 47 of the wall 39 of the second jaw 7 is beveled so as to facilitate the insertion of the second jaw 7 into an opening of a housing of an electrical connector.

Figure 3A:
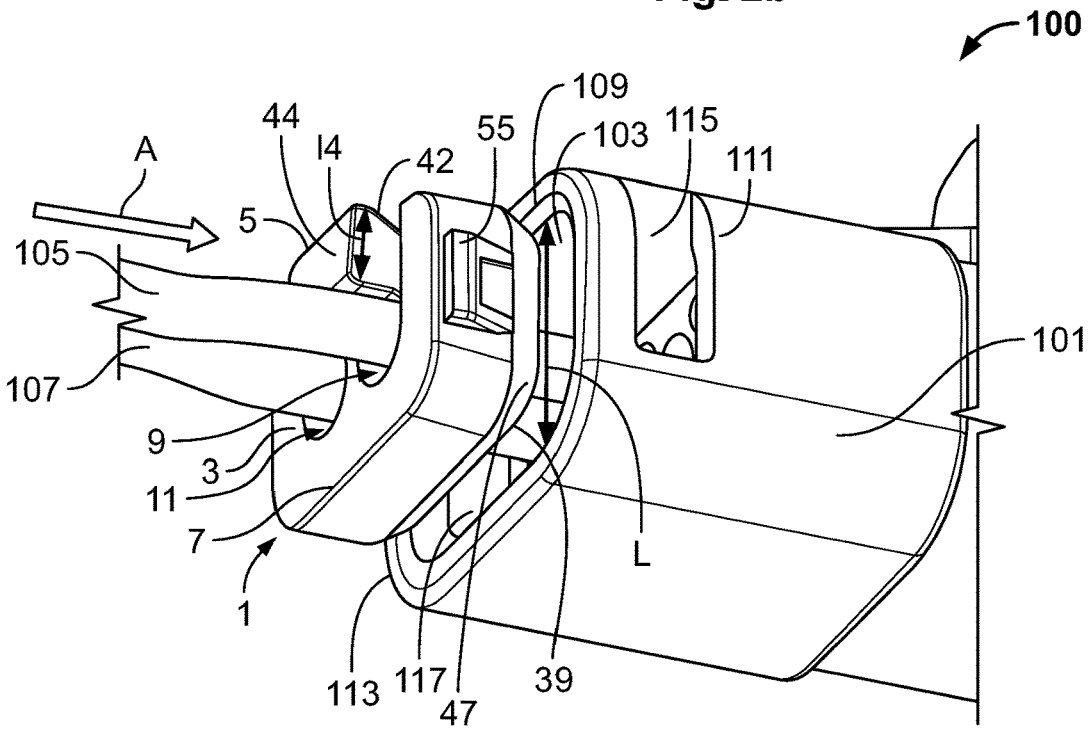
FIG. 3A is a perspective view of the electrical connector in a first step of assembly.

The clamping device 1 is shown in an assembly state in FIG. 3A. In the assembly state, the clamping device 1 is not inserted in the housing 101 and the jaws 5, 7 are open in such a way as to permit the introduction of the electrical cable 105 without needing to force the insertion. This step corresponds to a first step of a method for joining the clamping device 1 to the housing 101 of the electrical connector 100.

As shown in FIG. 3A, the sealed electrical connector 100 comprises the housing 101 having the opening 103 dimensioned for receiving the cable clamping device 1. Two electrical cables 105, 107 are already crimped inside the housing 101 of the sealed electrical connector 100. In other embodiments, there could be more, or fewer, than two electrical cables.

In the step shown in FIG. 3A, the cable clamping device 1 is slid along the electrical cables 105, 107 which are accommodated in the receiving orifices 9, 11 of the grid 3, in the introduction direction A.

The height 14 of the rear wall 44 of the first jaw 5 confers a dimension on the grid 3 considerably larger than the height L of the opening 103 of the housing 101. However, the structure in the shape of a ramp 42, 43 of the first jaw 5 makes it possible to facilitate the insertion of the clamping device 1 into the opening 103. In addition, the beveled periphery 47 of the wall 39 of the second jaw 7 likewise makes it possible to facilitate the insertion of the second jaw 7 into the opening 103, especially since a periphery 109 of the opening 103 of the housing 101 is likewise beveled.

The side walls 111, 113 of the housing 101, which are situated on either side of the opening 103, each have a hole 115, 117 configured to receive the protrusions 55 of the second jaw 7, permitting a snap-locking of the clamping device 1 in the housing 101.

Figure 3B:
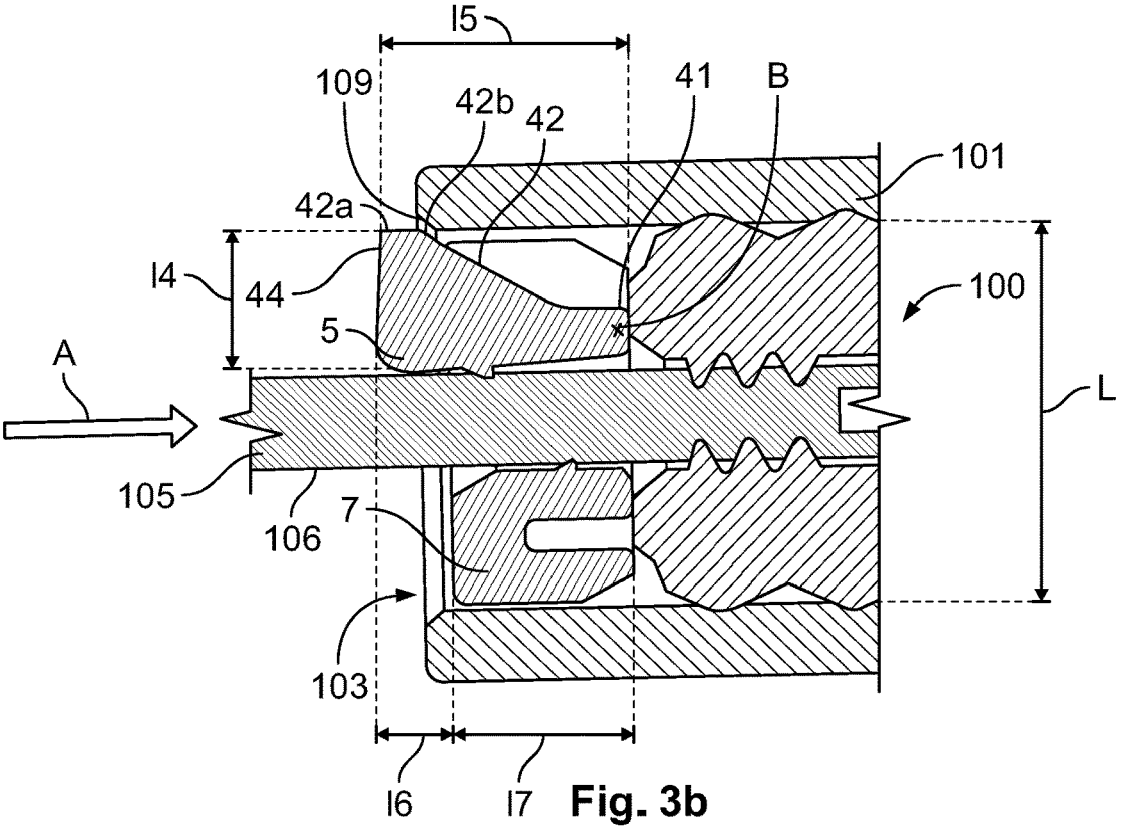
FIG. 3B is a sectional side view of the electrical connector in a second step of assembly.

A second step of assembling the clamping device 1 in the electrical connector 100 is shown in FIG. 3B. In this step, the clamping device 1 is already partially inserted inside the opening 103 of the housing 101.

As shown in FIG. 3B, the second jaw 7, the dimensions of which are complementary to the opening 103, is slid inside the housing 101. The first jaw 5 is likewise slid inside the housing 101 in such a way that the slopes of the ramps 42, 43 descend in the insertion direction A. Thus, the lower side 41 of the first jaw 5 is first of all introduced, then the clamping device 1 is pushed further inside the housing 101 until a part 42*b* just below the vertex 42*a* of the ramp 42 of the first jaw 5 comes to a stop on the beveled periphery 109 of the opening 103 of the electrical housing 101.

The pivoting of the jaw 5 is further facilitated by the difference in length, along the introduction direction A, between the depth 15 of the first jaw 5 and the depth 17 of the second jaw 7, with 15 longer than 17. Thus, a portion of a length 16 of the first jaw 5 towards the rear wall 44 extends beyond the second jaw 7 in a direction parallel to the introduction direction A. The portion of length 16 corresponds specifically to the side opposite the vertex 42*a* of the ramp 42.

Figure 3C:
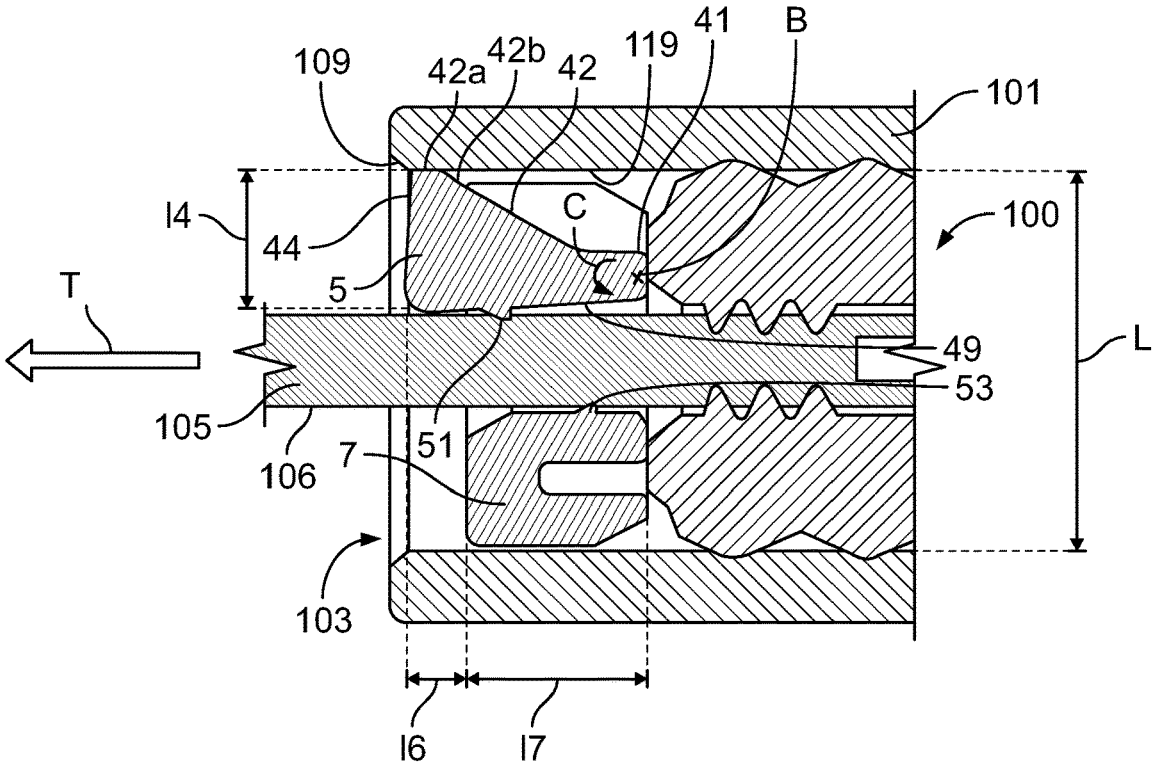
FIG. 3C is a sectional side view of the electrical connector in an assembled state.

The clamping device 1 and the electrical connector 100 are shown in an assembled state in FIG. 3C.

By pushing the clamping device 1 further in the insertion direction A, the abutment of the vertex 42*a*, 43*a* of the ramp 42, 43 of the first jaw 5 against the beveled periphery 109 of the opening 103 brings about the pivoting of the first jaw 5 around the rotation axis B as indicated by the arrow C. It is the difference in dimensions between the grid 3, especially the height 14 of the first jaw 5, and the height L of the opening 103 of the housing 101, which makes it possible to trigger the pivoting of the first jaw 5 during the introduction of the housing 101 into the opening 103.

The rotary pivoting of the first jaw 5 makes it possible to lower the internal wall 49 of the first jaw 5 towards the second jaw 7 as indicated by the arrow C, and thus to close the first jaw 5 and the second jaw 7 on the electrical cable 105 so as to jam the electrical cable 105. In addition, the protrusion 51 of the first jaw 5 and the protrusion 53 of the second jaw 7 hold the electrical cable 105 further, especially since the protrusions 51, 53 have a ramp shape, the slopes of which have directions opposed to one another, so as to improve the clamping of the electrical cable 105. The protrusions 51, 53 apply pressure on the insulation 106 of the electrical cable 105, which causes a jamming by friction and/or by shape between the protrusions 51, 53 and the insulation 106. The same is true of, and applies to, the second cable 107.

In the assembled state shown in FIG. 3C, the clamping device 1 is held by snap-locking by way of protrusions 55 and complementary holes 115, 117. In addition, the clamping device 1 is likewise held by friction between the vertex 42*a*, 43*a* of the ramp 42, 43 of the first jaw 5 and the internal wall 119 of the housing 101.

The clamping device 1 makes it possible to ensure the holding of the electrical cables 105, 107 in a sealed electrical connector 100, in particular when they are under tensile stress shown by the arrow T in FIG. 3C. The crimping of the conducting core of the electrical cable 105, 107 in addition to the clamping of the insulation 106 of the cable 105, 107 by the clamping device 1, makes it possible to improve the resistance of the electrical cables 105, 107 when they are under tensile stress T. Such a sealed electrical connector 100 with the clamping device 1 is thus suitable for use in environments which are subject to vibrations and/or to impacts.

What is claimed is:

1. A cable clamping device for a housing of a sealed electrical connector, the cable clamping device comprising:
   a grid having an orifice adapted to receive a cable and clamp the cable in the orifice, a direction of introduction of the grid into an opening of the housing is parallel to a direction of introduction of the cable into the orifice of the grid, the grid has a first jaw and a second jaw forming the orifice between the first jaw and the second jaw, the first jaw is pivoted in rotation with respect to the second jaw as the grid is introduced into the opening of the housing.

2. The cable clamping device of claim 1, wherein the first jaw and the second jaw clamp the cable in the orifice by closing upon introduction of the first jaw and the second jaw into the opening of the housing.

3. The cable clamping device of claim 2, wherein the first jaw is mounted at an elastically deformable hinge to the second jaw.

4. The cable clamping device of claim 3, wherein, in an assembly state in which the clamping device is not inserted in the housing, the first jaw and the second jaw are open and permit introduction of the cable.

5. The cable clamping device of claim 4, wherein, in an assembled state in which the clamping device is inserted into the housing, the first jaw and the second jaw are closed to clamp the cable.

6. The cable clamping device of claim 5, wherein the first jaw has a ramp with a slope descending in the direction of introduction of the grid into the opening of the housing.

7. The cable clamping device of claim 6, wherein a vertex of the ramp is dimensioned so that the insertion of the first jaw into the opening of the housing causes the first jaw to pivot with respect to the second jaw and clamp the cable.

8. The cable clamping device of claim 6, wherein the first jaw extends beyond the second jaw in a direction parallel to the direction of introduction of the grid into the opening of the housing.

9. The cable clamping device of claim 5, wherein a face of the first jaw and/or the second jaw configured to be in contact with the cable in the assembled state has a protrusion engaging the cable.

10. The cable clamping device of claim 5, wherein a wall of the second jaw facing an internal wall of the opening of the housing in the assembled state has a protrusion adapted to snap-lock the grid in the housing.

11. The cable clamping device of claim 1, wherein the cable clamping device is formed in a single monolithic piece from an elastically deformable plastic material.

12. An electrical connector, comprising:
   a housing having an opening adapted to receive a cable; and
   a cable clamping device having a grid with an orifice adapted to receive the cable and clamp the cable in the orifice, a direction of introduction of the grid into the opening of the housing is parallel to a direction of introduction of the cable into the orifice of the grid, the grid has a first jaw and a second jaw forming the orifice between the first jaw and the second jaw, the first jaw is pivoted in rotation with respect to the second jaw as the grid is introduced into the opening of the housing.

13. The electrical connector of claim 12, wherein the first jaw and the second jaw each have a retaining shape adapted to jam the cable between the first jaw and the second jaw in the direction of introduction of the grid into the opening of the housing.

14. A method for joining a cable clamping device to a housing of a sealed electrical connector, comprising:
   providing the cable clamping device including a grid having an orifice adapted to receive a cable, the grid has a first jaw and a second jaw forming the orifice between the first jaw and the second jaw;
   sliding the grid along the cable as far as an opening of the housing; and
   pushing the grid into the opening of the housing, after sliding the grid along the cable, and pivoting the first jaw until the first jaw and the second jaw clamp the cable in the orifice.

15. The method of claim 14, wherein in the pushing step, when the grid is introduced into the housing, an abutment of a vertex of a ramp of the first jaw against an internal wall of the opening of the housing causes the pivoting of the first jaw.

16. The method of claim 14, wherein in the pushing step, when the grid is introduced into the housing, a protrusion of the second jaw engages a hole of the housing and snap-locks the grid in the housing.

17. The cable clamping device of claim 3, wherein the first jaw is capable of being pivoted in rotation with respect to the second jaw about a rotation axis of the elastically deformable hinge, the rotation axis extends perpendicular to the direction of introduction of the cable into the orifice of the grid.

18. The cable clamping device of claim 3, wherein the elastically deformable hinge connects a pair of opposite sides of the first jaw to the second jaw.

19. A cable clamping device for a housing of a sealed electrical connector, the cable clamping device comprising:
   a grid having an orifice adapted to receive a cable and clamp the cable in the orifice, the grid has a first jaw and a second jaw forming the orifice between the first jaw and the second jaw, the first jaw and the second jaw are mobile with respect to one another and clamp the cable in the orifice by closing upon introduction of the first jaw and the second jaw into an opening of the housing, the first jaw extends beyond the second jaw in a direction parallel to a direction of introduction of the grid into the opening of the housing.

* * * * *